United States Patent [19]

Grindrod et al.

[11] Patent Number: 4,850,504

[45] Date of Patent: Jul. 25, 1989

[54] SPRING RING EASY-OPEN POSITIVE-RECLOSE HERMETIC FOOD PACKAGE

[75] Inventors: Paul E. Grindrod, Madison; Ray H. Griesbach, Monona; Gerald O. Hustad, McFarland, all of Wis.

[73] Assignee: Oscar Mayer Foods Corporation, Madison, Wis.

[21] Appl. No.: 266,723

[22] Filed: Nov. 3, 1988

[51] Int. Cl.[4] ..... B65D 41/00

[52] U.S. Cl. ..... 220/307; 220/73; 220/306

[58] Field of Search ..... 220/307, 306, 350, 352, 220/356, 73

[56] References Cited

U.S. PATENT DOCUMENTS

| | | | |
|---|---|---|---|
| 3,173,571 | 3/1965 | Cserny et al. | 220/306 X |
| 3,498,018 | 3/1970 | Seiferth et al. | 206/525 X |
| 3,595,428 | 7/1971 | Mounts et al. | 220/306 X |
| 4,427,705 | 1/1984 | Wyslotsky et al. | 220/306 X |
| 4,529,100 | 7/1985 | Ingemann | 220/359 |
| 4,530,442 | 7/1985 | Vogel, Jr. et al. | 220/73 X |
| 4,643,329 | 2/1987 | Mobberley et al. | 220/307 X |
| 4,741,452 | 5/1988 | Holzkopf | 220/356 X |

*Primary Examiner*—Steven M. Pollard

*Attorney, Agent, or Firm*—Joseph T. Harcarik; Thomas R. Savoie; Daniel J. Donovan

[57] ABSTRACT

This invention relates to packaging and is more particularly concerned with improvements in a package and method of forming the same in which the meat or perishable food package can be easily opened and reclosed while positively conveying a positive perception to the customer that the package is hermetically sealed before it is opened and that the package is positively resealable. An opening and reclosure cap provides an audible snap as it is opened and a similar audible snap as it is reclosed.

1 Claim, 2 Drawing Sheets

SPRING RING EASY-OPEN POSITIVE-RECLOSE HERMETIC FOOD PACKAGE

FIELD OF THE INVENTION

This invention relates to packaging and is more particularly concerned with improvements in a package and method of forming the same in which the meat or perishable food package can be easily opened and reclosed while positively conveying a positive perception to the customer that the package is hermetically sealed before it is opened and that the package is positively resealable. An opening and reclosure cap provides an audible snap as it is opened and a similar audible snap as it is reclosed.

DESCRIPTION OF THE PRIOR ART

Vacuum packed packages for proteinaceous material such as sliced luncheon meats, are sealed by a variety of known methods. One method produces a peelable heat seal by employing slightly dissimilar materials such as polyethylene to ethylene copolymers, ethylene copolymers to ionomers, polyethylene to polypropylene, low density polyethylene to medium density polyethylene and mixtures of these materials to slightly different mixtures. These seals are not resealable. Another method is to employ a soft, hot-melt adhesive seal of similar and different substrates such as Earex (acrylonitrile-methyl acylate copolymer polymerized and/or mixed with butadiene as a terpolymer) to Barex, Barex to polyethylene, polyester to polyethylene, Saran to Barex, Saran to PVC, PVC to polyethylene and PVC to PVC. Seals are made by applying hot melt adhesive of relatively low viscosity to one of the rigid package components in an annular ring and subsequently heat sealing the companion package component to the adhesive ring. Still another method is to employ high molecular weight polymer adhesives which are peelably resealable.

The described hot-melt seals permit easy opening by peeling the package components apart. Opening is usually accompanied by a significant occurrence of cohesive adhesive failure where the adhesive itself ruptures with a tendency toward stringing as the adhesive clings to diverging substrates. Cohesive failure and stringing occurs because the internal cohesive strength of the soft low molecular weight adhesive is less than the adhesive strength at the substrate/adhesive interface. These package components can be resealed, but resealing is complicated by stringing, displaced adhesive and warped, stretched package components. The customer perceives such reclosure as potentially non-hermetic.

A description indicating adhesives for providing sealed vacuum packaged products employing both rigid and flexible package parts can be found for example in U.S. Pat. No. 3,498,018 to Seiferth, et al. The Seiferth, et al disclosure shows a sliced meat package comprising a pre-formed cup-shape container body of deformable semi-rigid plastic material. The cup-shaped container body has an integral planar flange adjacent the mouth of the body. A closure member of the formable material is provided by a portion overlying the mouth of the container, said portion being adapted for sealing said cup-shape body in intimate pressure engagement with the product on the interior of the container body.

Known existing luncheon packages can be generally classified into three groups as follows:

1. Packages that are sealed together with a fused polyethylene to polyethylene or Surlyn to Surlyn seal. These packages are neither easy open nor do they reclose effectively.

2. Packages that are sealed together with a peelable polyolefin combination where sealing surfaces do not fuse. These packages can be easily peeled open but do not reclose effectively.

3. Packages thare are sealed together with a sticky, hot-melted adhesive. These packages can be easily peeled open and resealed. However, this latter class of packages does not convey the impression to the consumer that the package is effectively resealed because the adhesive pattern is disturbed and the package materials are often stretched and warped when the package is peeled open.

U.S. Pat. No. 4,529,100 discloses a three-piece package containing a weaken zone as for example shown in FIGS. 5*g* and 5*h*.

Accordingly, one object of the present invention is to provide a resealable package wherein the customer perceives positive reclosure with the packages that snap apart and together like package products that the consumer is already familiar with. Another object of the present invention is to provide a three part package, incorporating a spring ring that permits easy opening and positive reclosure with a clear, definitive audible snap yielding a perception to the customer of hermeticity in both the unopened and reclosed packages.

Further, another object of the present invention is to provide a package for luncheon meat or other perishable food having a cup-shape container body of thermoformed plastic, the container body having a radially extending flange externally at its mouth. The package also includes a planar member for forming a flange adjacent the container body mouth, said planar member having a first surface, an opening and ring means formed on the inner periphery of said opening. The container body is mounted on the planar member with the radially extending flange being attached by adhesives or other means against one face of the planar member so that the mouth of the container body is in registry with the opening in the planar member. Furthermore, the ring means formed on the inner periphery of the opening in the planar member extends inside of the mouth of the container around the inner periphery of said mouth. Further, the package includes a reclosable closure member of thermoformed plastic, the closure member having a portion overlying the mouth of the container body and being adapted for sealing the cup-shaped body in engagement with the product. The closure member has lug forming means adjacent its periphery to engage with the ring means and to create an audible snap as said closure member is removed from or replaced in said mouth. In the initial package form the closure member is a thermoformed cup with an outwardly extending flange which is adhesively attached to the other side of the planar member by means of a non-sticky sealant to form a hermetic, but easily peelable, heat seal against the surface of the planar member.

Still a further object of the present invention is to provide an improved method for forming a package for meat or other perishable food, said package having the above characteristics and advantages.

These and other objects and advantages of the invention will be apparent from a consideration of the several forms of the package and the method of forming the same which are shown by way of illustration in the accompanying drawings wherein:

DESCRIPTION OF THE PREFERRED EMBODIMENTS

The package of the present invention in useful in the marketing of food products, particularly processed meat products, for example, sliced bologna or the like which is customarily packaged in stacks of a predetermined weight with the result that the stack to be enclosed in the individual wrapper or container is of non-uniform volume and dimension while at the same time having a degree of compressibility which enables it to be shaped or molded within limits, so that it will fill the product space within a preformed contained. Accordingly, for purposes of illustration, a package 10 is shown in FIGS. 1 through 4 in which the product 11 is a stack of meat slices, the package of FIG. 1 being shown in an upright position.

Figure 1:
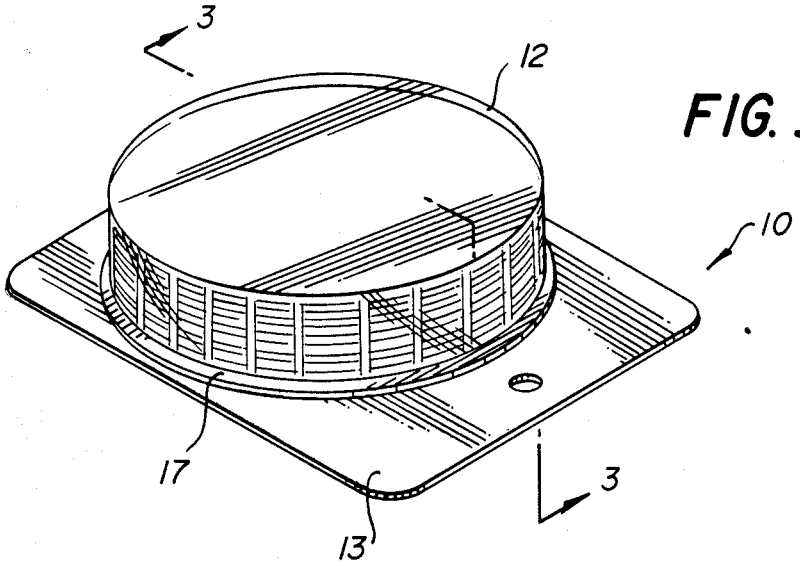
FIG. 1 is a perspective view of a typical package of a sliced meat product which is formed in accordance with the present invention.
Figure 2:
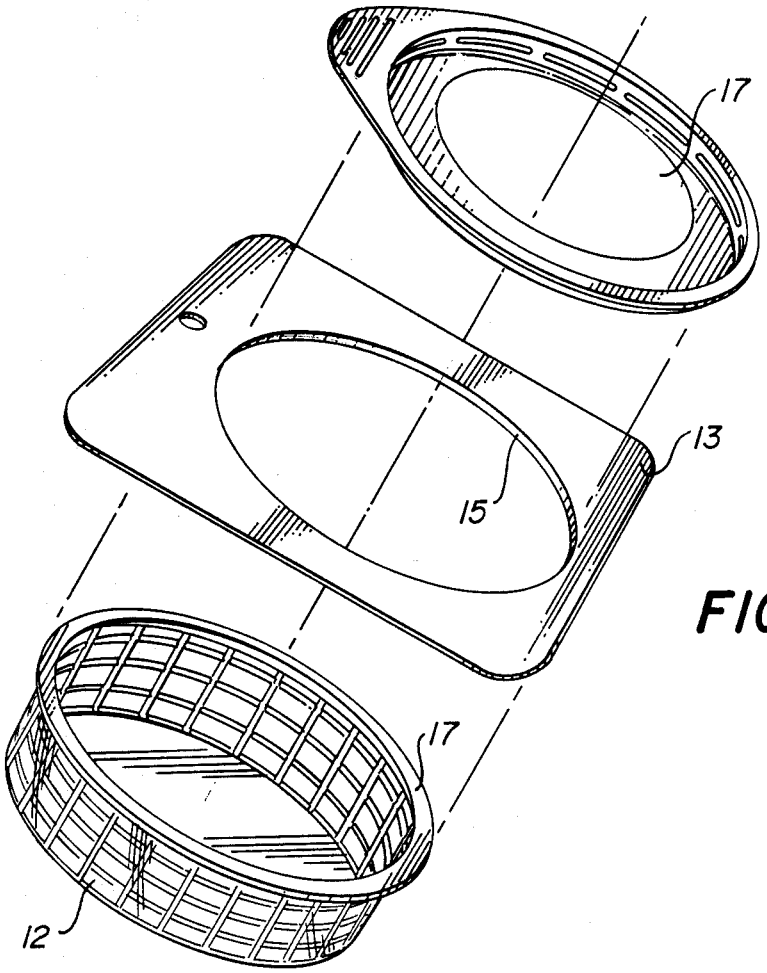
FIG. 2 is an exploded perspective view of the typical package shown in FIG. 1.
Figure 4:
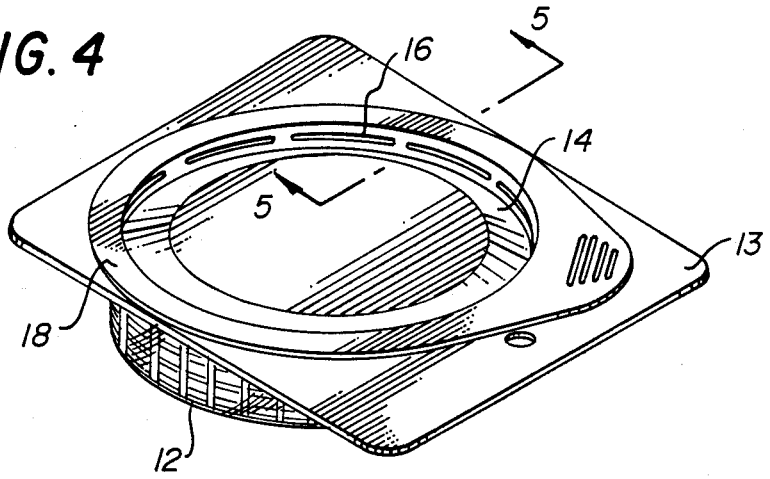
FIG. 4 is a perspective view of the bottom side of the typical package of sliced meat product shown in FIG. 1.
Figure 3:
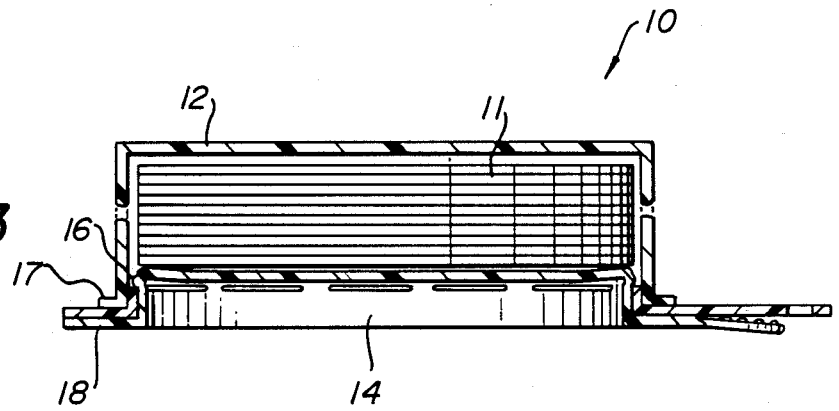
FIG. 3 is a cross-sectional view of the package in FIG. 1 taken along 3—3.

According to FIGS. 1 through 4, the package of the present invention comprises three parts as shown in more detail in the exploded FIG. 2.

Part 14 is a reclosable closure member which is in the form of a thermoformed cap which may be stiffened by the insertion of a paper board label into its cavity.

Part 13 is a planar member or flat sheet of plastic with an opening or hole formed in it to fit cap 14. However, the planar member 13 has a downwardly pointing wall 15 approximately $\frac{1}{8}$ to $\frac{1}{4}$ inch deep thermoformed around the periphery of the opening or hole. The downwardly pointing wall 15 forms a spring ring means. The downwardly formed wall has small claws thermoformed therein which point toward the center and are adapted to engage the lugs 16 formed on 14. The lugs on Part 14 can be in the form of a continuous groove or segmented and can be either male lugs extending outwardly or female cavities extending inwardly.

Part 12 in FIG. 2 is a cup-shaped container body of thermoformed plastic, the container having a radially extending flange 17 at its mouth. In FIG. 2, part 12 is adhered to the downward side face of the planar member 13 by means of, for example, a permanent hot-melt adhesive. Part 14, the package closure, is provided with a non-sticky sealant on the down side of the flange area 18 to make a hermetic, but easily peelable, heat seal against the upper part of planar member 13 in FIG. 2. With the present invention, which uses a three part package, incorporating a spring ring, it has been found that it solves the problem created by an inflexible lugged package and it permits easy opening and positive reclosure with a clear, definitive audible snap in and out, thus yielding a perception to the consumer of hermeticity in both the unopened and reclosed package format.

Figure 5:
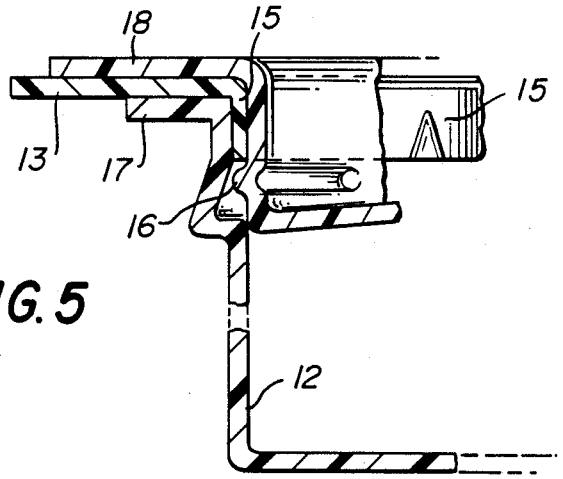
FIG. 5 is a fragmentary section, to an enlarged scale, taken along line 5—5 in FIG. 4.

In explanation of the above, planar member 13 in FIG. 2, includes a spring ring means 15 formed on the inner periphery of the opening. This spring ring means may be created from a flat sheet of material which is thermoformed with a $\frac{1}{4}$ inch high pedestal. The top of the pedestal then is cut out and the $\frac{1}{4}$ inch vertical wall which remains is corrugated to form teeth which slant inwardly. The geometry of this spring ring means 15 structure provides elasticity in the corrugated $\frac{1}{4}$ inch circular wall. When the internal cap 14 with either male lugs or female cavities is inserted into the spring ring means 15, the spring means expands like a garter to encompass the internal cap and the teeth of the spring ring means embed their sharp edges around the lugs or into the female cavities. This is best seen in enlarged FIG. 5 where lug 16 is snapped past the bottom edge of ring means 15.

When the package is opened by pulling out the internal cap or plug, the spring ring means expands and releases its teeth from the lugs or cavities in the plug with a sharply audible snap. Similarly, when the cap or plug is returned to reclose the package, the spring ring means expands and closes upon the lugs or cavities with a definitive positive snap.

Accordingly, it can be seen that this invention provides precise audible opening and closing better than convention lugs because the external member is elastic, the teeth grasping the lugs or cavities are sharp and the internal cap or plug can be made suitably stiff by the inclusion of paper board labeling stock in its concavity.

It is apparent that the spring ring means has numerous advantages for use in an easy open-positive reclosable package. They are:

1. The package is easy to open with an audible snap.
2. The package is easy to reclose with a positive reclosure having an audible snap.
3. There is a reduction of material required for the cup-shaped body of bubble containing the food.

Since this material is a relatively expensive oxygen barrier plastic such as Barex, PVC or polyester, the reduction in the size of the conventional flange area to $\frac{1}{8}$ to $\frac{1}{4}$ inch larger than the bubble diameter provides a significant cost reduction.

4. Substitution of polystyrene for Barex, PVC or PET for the spring ring means, which is the substitute flange area for the bubble, provides a significant saving because polystyrene costs less than one half the cost of barrier plastics. The reduction of material required for the internal cap or plug is obtained because the large flange area usually associated with the conventional package component can be reduced to $\frac{1}{8}$ to $\frac{1}{4}$ inch around the opening at the top of the cap. The reduction of stresses in the adhesive seal of the internal cup or plug on the flange area of the spring ring means permits the use of simple non-tacky heat sealants which are easier to open with no stringing or other negatives from a cosmetic standpoint.

FIGS. 12 through 15 of the above-mentioned U.S. Pat. No. 3,498,018 to Seiferth, et al. show a known rigid two-piece luncheon meat package which the present invention is intended to improve. The known package is composed of a thermoformed cup or bubble with a large flange area which is adhered to a pedestal base or internal cap or plug with a ring of hot-melt adhesive around the opposite, side of the pedestal. The known pickage can be made in multiple groups in a single thermoformed sheet by filling a tray of bubbles with sliced meat product, superimposing a mating tray of pedestal bases thereupon, vacuumizing, heat sealing and trimming. Removal of the pedestal base by the consumer breaks the adhesive seal and slightly distorts the pedestal base and flange. Resealing of the pedestal base in the bubble by the consumer lacks definitive articulation even with lugs built into the base and bubble.

The three-piece package of the present invention is composed of a bubble similar to the conventional package above but with a much smaller flange area of $\frac{1}{8}$ to $\frac{1}{4}$ inch wide. The pedestal base (internal cap or plug) is similar to the conventional package except that the flange area is reduced to $\frac{1}{8}$ to $\frac{1}{4}$ inches in width and the walls of the pedestal are thermoformed with small lugs or female cavities or grooves and the base may be stiffened by the insertion of a paper board label or other appropriate stiffening means. The spring ring means provides the flange area equivalent to the convention package and may be made from low cost, non-barrier plastic sheets, such as polystyrene or polyolefin. It should be understood that an additional option with the spring ring means is to make the flange area of suitable paper board and to incorporate a plastic injection-molded polystyrene ring in the center of the paper board secured by a molded press fit.

If the spring ring means is made of polystyrene, it may be thermoformed just like a conventional pedestal base and may incorporate flutes or undulations in the pedestal wall of an appropriate magnitude. The flat planar supporting surface of the pedestal may be trimmed out leaving the sharp edges of the fluted ring with an appropriate number of claw-like edges.

Assembly of the three-piece package according to the present invention utilize hot melt adhesive application to the flange area of the bubble or, alternatively, to the corresponding mating surface of the spring ring. Such adhesive is a high strength permanent hot melt such as, for example, National 70-2778. It should be understood that adhesive should also be applied to the flange area of the pedestal base or the corresponding mating surface of the planar member of the spring ring means. This latter adhesive may be a non-tacky heat sealant based upon ELVAX 40.

Package fabrication of the present invention can be accomplished with either a single or a multiple package system. If the single package system is utilized, the following sequential steps may be utilized:

1. Thermoform, trim, and apply adhesive to the Barex bubble; stack with the aid of stacking lugs; transport stacks.
2. Thermoform polystyrene pedestal base with fluted walls; trim out the supporting floor of the pedestal leaving a fluted spring ring means; stack said pedestal bases.
3. Thermoform Barex pedestal bases with lugs, cavities or grooves in the wall; insert paper board label using adhesive if necessary; trim and stack.
4. Utilize available canning machine technology to fill, assemble, vacuumize and seal the package.

If a multiple package fabrication approach is used, units of 10 packages in a 5×2 configuration may be assembled by the following method:

1. Thermoform the spring ring component of the package in 5×2, ten unit trays from polystyrene; trim out the center portion of the spring ring.
2. Thermoform 5×10, 5×2, ten unit trays of bubbles, apply permanent adhesive; trim from the web aligning each trimmed bubble upon the hole in the 5×2, ten unit spring ring tray; the bubble will adhere to the tray without sealing because of the pressure sensitive permanent adhesive.
3. Handle the spring ring unit tray with adhering bubbles similar to conventional bubble trays.
4. Thermoform Barex pedestal base in any multiple configuration; add paper board labels to the base in the web; apply adhesive, trim and stack.
5. Fill the composite bubble trays with sliced meat product; add snap-in pedestal base; insert the tray in a SNSR closure; vacuumize and seal, trim and label.

It should be understood to one skilled in the art that many alternative production methods may be used ranging from those requiring high labor to those methods utilizing capital intensive automated techniques.

In use the package according to the present invention operates as follows:

1. The hand tab on the pedestal base internal cap or plug is pulled by the user outwardly rupturing the non-tacky heat sealant between the flange area of the base and the spring ring component.
2. The continued pulling on the tab forces the claws in the spring ring means outward and they expand similar to a stretched garter permitting the lugs or cavities on the pedestal base to slide outwardly with a resulting snap by the spring ring.
3. The dimensionally stablized pedestal base is pushed back into the spring ring cavity again expanding the claws. By continued pushing, the claws clear the lugs (or cavities) and snap into place with an audible snap to secure the pedestal base firmly against the spring ring flange surface.

It will be understood that variations and modifications may be effected without departing from the spirit and scope of the novel concepts of the present invention.

We claim as our invention:

1. A package for meat or other perishable food comprising:

a cup-shaped container body of thermoformed plastic, said container having a radially extending flange at the periphery of its mouth;

a planar member defining a flange adjacent said mouth, said planar member having a first surface, an opening and a ring means formed on the inner periphery of said opening;

said container body being mounted on said planar member with said radially extending flange being attached against one face of said planar member so that the mouth of said container body is in registry with the opening in said planar member and said ring means extends inside of and around the inner periphery of said mouth; and a reclosable closure member of the thermoformed plastic, said closure member having a portion overlying the mouth of said container body and being adapted for sealing said cup-shaped body in engagement with said food, said closure member having means forming lugs adjacent its periphery to engage said ring means and to create an audible snap sound as said closure member is removed from or replaced in said mouth of said container body.

* * * * *

UNITED STATES PATENT AND TRADEMARK OFFICE

CERTIFICATE OF CORRECTION

PATENT NO. : 4,850,504

DATED : July 25, 1989

INVENTOR(S) : Grindrod et al

It is certified that error appears in the above-identified patent and that said Letters Patent is hereby corrected as shown below:

Col. 2, Line 9, "thare" should read --that--.
Col. 3, Line 19, "in useful" should read --is useful--.
Col. 3, Line 28, "contained" should read --container--.
Col. 4, Line 65, after --opposite-- delete ",".
Col. 4, Line 66, "pickage" should read --package--.

Signed and Sealed this

Twenty-second Day of May, 1990

*Attest:*

HARRY F. MANBECK, JR.

*Attesting Officer*

*Commissioner of Patents and Trademarks*